US009028309B2

(12) United States Patent
Rimmer

(10) Patent No.: US 9,028,309 B2
(45) Date of Patent: May 12, 2015

(54) DIFFUSER MOUNTING FLANGE

(75) Inventor: Julian Rimmer, Winnipeg (CA)

(73) Assignee: Price Companies, Inc. (CA)

( * ) Notice: Subject to any disclaimer, the term of this patent is extended or adjusted under 35 U.S.C. 154(b) by 860 days.

(21) Appl. No.: 11/968,995

(22) Filed: Jan. 3, 2008

(65) Prior Publication Data

US 2009/0318073 A1 Dec. 24, 2009

Related U.S. Application Data

(60) Provisional application No. 60/940,842, filed on May 30, 2007.

(51) Int. Cl.
*F24F 7/00* (2006.01)
*F24F 13/08* (2006.01)
*F24F 13/06* (2006.01)

(52) U.S. Cl.
CPC ..... *F24F 13/084* (2013.01); *F24F 13/06* (2013.01); *F24F 2221/40* (2013.01)

(58) Field of Classification Search
CPC ..... F24F 13/06; F24F 13/084; F24F 2221/40
USPC ..... 248/292.12, 312.1, 314, 316.7, 342, 248/27.3, 27.1, 681, 312, 1; 454/289, 290, 454/184; 362/434, 436, 438, 441, 449, 364, 362/365, 366; 381/386, 389; 29/700
See application file for complete search history.

(56) References Cited

U.S. PATENT DOCUMENTS 2,209,146 A * 7/1940 Bessette ..... 220/3.9
3,866,950 A * 2/1975 Skoch et al. ..... 285/4
3,871,606 A * 3/1975 Larson et al. ..... 248/27.1
3,966,152 A * 6/1976 Bromberg ..... 248/27.1
4,053,082 A * 10/1977 Ullman ..... 220/3.6
4,250,540 A * 2/1981 Kristofek ..... 362/368
4,293,895 A 10/1981 Kristofek
4,297,525 A * 10/1981 Bowden, Jr. ..... 174/58
4,431,151 A 2/1984 Schonasky
4,549,474 A * 10/1985 Fey et al. ..... 454/289
4,576,349 A 3/1986 Dearing
4,605,816 A * 8/1986 Jorgensen et al. ..... 174/661
4,669,371 A 6/1987 Sarazen
4,716,504 A 12/1987 Pahl et al.
4,739,460 A 4/1988 Kelsall
4,801,316 A 1/1989 Schroeder
5,058,490 A 10/1991 Sodec
5,077,650 A * 12/1991 Cestari ..... 362/365
5,109,756 A * 5/1992 Barboza et al. ..... 454/284
5,122,944 A * 6/1992 Webb ..... 362/365
5,163,871 A * 11/1992 Huibregtse et al. ..... 454/289
5,236,157 A * 8/1993 Reggiani ..... 248/27.1

(Continued)

*Primary Examiner* — Gregory Huson
*Assistant Examiner* — Dana Tighe
(74) *Attorney, Agent, or Firm* — Smith, Gambrell & Russell

(57) ABSTRACT

A mounting flange for attaching an HVAC air diffuser terminal in an opening in a floor or other mounting surface. The mounting flange includes a trim ring and a flange clip. The flange clip is adjustably and movably received in a slot defined a side of the trim ring. A pawl on the flange clip engages with ratchets defined in a surface of the trim ring adjacent to the slot to maintain the flange clip in selected position relative the underside of a floor. The air diffuser terminal is secured in the floor opening between gripping surfaces on the flange clip and the trim ring. An optional screw operably connects the flange clip with the trim ring so that the diffuser may be securely tightened in the floor opening.

32 Claims, 5 Drawing Sheets

(56) References Cited

U.S. PATENT DOCUMENTS

| | | | | |
|---|---|---|---|---|
| 5,331,119 | A * | 7/1994 | Leger et al. | 181/150 |
| 5,338,255 | A | 8/1994 | Akehurst | |
| 5,410,782 | A * | 5/1995 | Holyoake | 24/505 |
| 5,494,244 | A | 2/1996 | Walton | |
| 5,496,213 | A | 3/1996 | Miller | |
| 5,800,259 | A | 9/1998 | Olney | |
| 5,910,045 | A * | 6/1999 | Aoki et al. | 454/186 |
| 5,931,432 | A * | 8/1999 | Herold et al. | 248/343 |
| 5,938,525 | A * | 8/1999 | Birdsong et al. | 454/290 |
| 5,964,523 | A * | 10/1999 | Eversberg | 362/365 |
| 6,050,892 | A * | 4/2000 | Sodec | 454/289 |
| 6,083,100 | A * | 7/2000 | Hardy et al. | 454/290 |
| 6,231,438 | B1 * | 5/2001 | Laudermilk | 454/290 |
| 6,290,596 | B1 * | 9/2001 | Birdsong et al. | 454/289 |
| 6,361,432 | B1 | 3/2002 | Walker | |
| 6,375,142 | B1 * | 4/2002 | Miller et al. | 248/316.1 |
| 6,478,673 | B1 * | 11/2002 | Haynes | 454/292 |
| 6,506,113 | B2 | 1/2003 | Berger | |
| 6,544,117 | B1 * | 4/2003 | Hardy | 454/290 |
| 6,554,880 | B1 | 4/2003 | Norathcutt | |
| 6,683,963 | B2 * | 1/2004 | Sterns et al. | 381/182 |
| 6,931,794 | B1 | 8/2005 | Burgess | |
| 6,957,896 | B2 | 10/2005 | Burgess | |
| 7,022,010 | B1 | 4/2006 | Cardon | |
| 7,108,600 | B1 * | 9/2006 | Krzyskowski et al. | 454/332 |
| 7,320,638 | B2 * | 1/2008 | Craig | 454/290 |
| 7,334,767 | B2 * | 2/2008 | Wright | 248/342 |
| 7,357,541 | B2 * | 4/2008 | Gamache et al. | 362/448 |
| 7,530,705 | B2 * | 5/2009 | Czech et al. | 362/147 |
| 7,628,686 | B2 * | 12/2009 | Rimmer et al. | 454/290 |
| 7,673,842 | B2 * | 3/2010 | Nevers et al. | 248/343 |
| 7,731,130 | B2 * | 6/2010 | Decanio et al. | 248/27.3 |
| 7,780,135 | B2 * | 8/2010 | Nelson et al. | 248/342 |
| 7,841,930 | B2 * | 11/2010 | Rimmer et al. | 454/290 |
| 2005/0072891 | A1 * | 4/2005 | Wright | 248/342 |
| 2006/0246835 | A1 * | 11/2006 | Rimmer et al. | 454/290 |
| 2009/0061757 | A1 * | 3/2009 | Rimmer et al. | 454/290 |

* cited by examiner

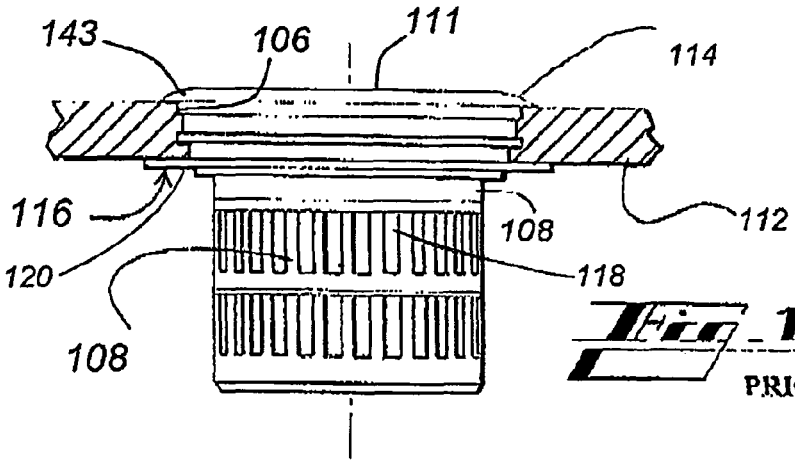
Fig. 1
PRIOR ART
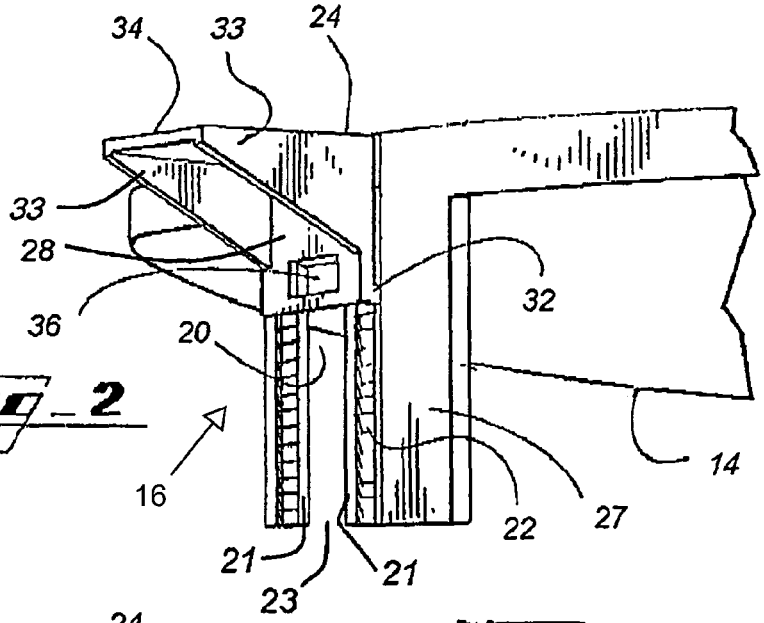
Fig. 2
Fig. 3
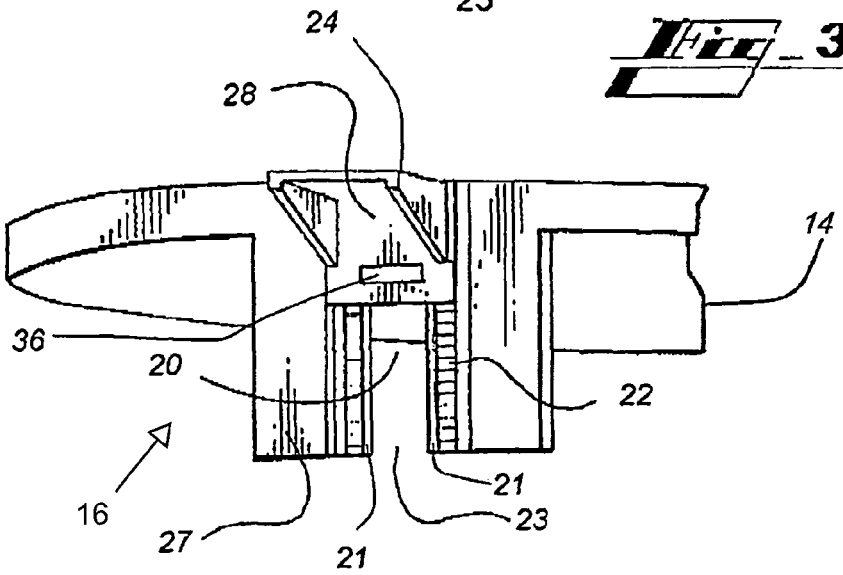

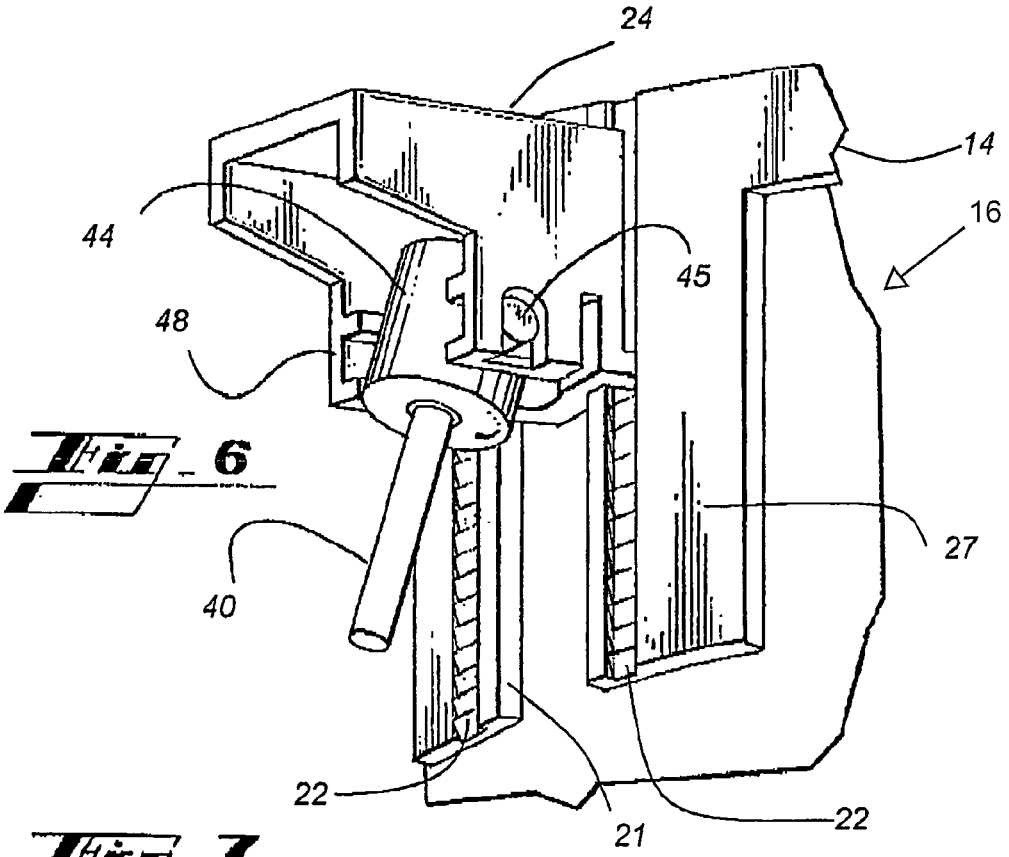
Fig. 6
Fig. 7
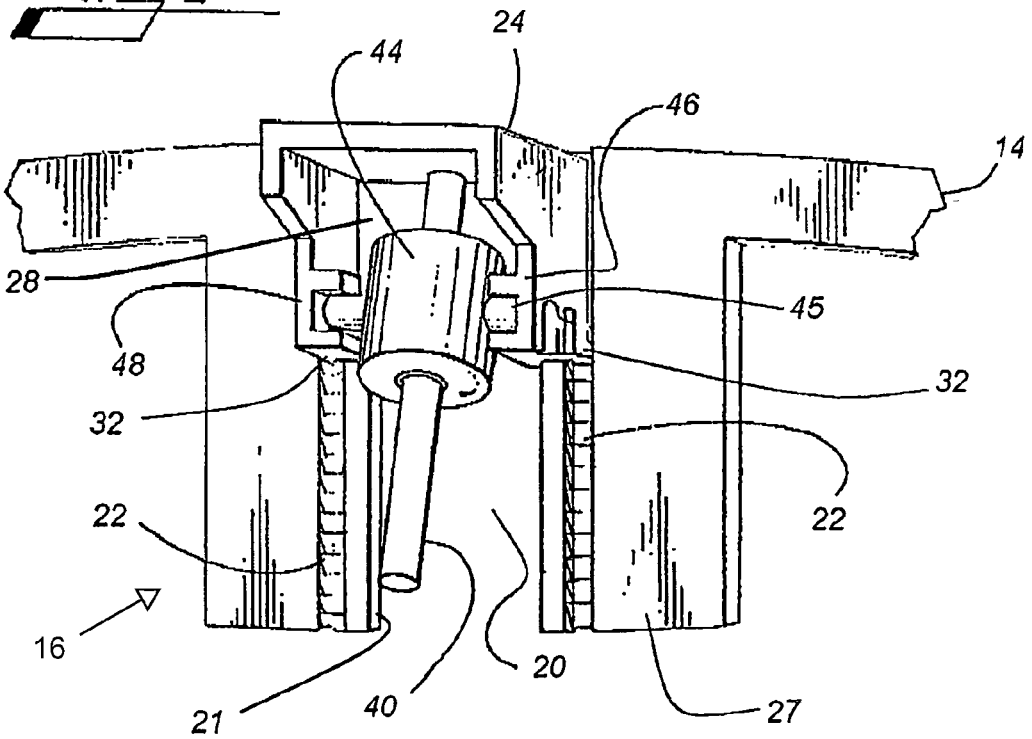

DIFFUSER MOUNTING FLANGE

CROSS REFERENCE TO RELATED APPLICATIONS

This application claims the benefit of prior U.S. Provisional application Ser. No. 60/940,842, filed May 30, 2007.

FIELD OF THE INVENTION

The invention relates to air diffuser terminals utilized with HVAC distribution systems. More particularly, the invention relates to an improved mounting flange and method for installing an air diffuser terminal, especially in a floor opening. With greater particularity, the invention relates to a mounting flange with a ratchet and a pawl for securing the air diffuser terminal in a floor opening.

BACKGROUND OF THE INVENTION

Under floor HVAC systems carry conditioned air through a plenum located beneath the floor of an occupied space. The conditioned air flows into the occupied space via one or more air diffuser terminals mounted in openings in the floor. The air diffuser terminals are located at various positions in the floor to distribute the conditioned air evenly within the occupied space. In modular floor configurations, the air diffuser terminals may be relocated to accommodate changes in the work layout of the room, increased or decreased worker capacity, or changes in the intended utilization of the occupied space. Accordingly, it is useful in the art to have an HVAC air diffuser terminal that may be readily relocated within the occupied space. Because such air diffuser terminals are floor mounted, the air diffuser terminals must be securely mounted in the floor to ensure the safety of the occupants.

Typical floor mounted HVAC air diffuser terminals include a basket, a diffuser grille, and a mounting flange. The mounting flange secures the air diffuser terminal in the opening in the floor or other support structure. Conditioned air from the under floor air plenum is delivered to the occupied space above the floor through the basket and the diffuser grille. In some installations, the modular terminal basket includes a stationary round basket and rotatable internal round basket. Both the stationary basket and the rotatable basket have openings in their sides and bottoms, such that rotation of the internal basket relative to the stationary basket opens and closes the openings to control the amount of air that flows through the terminal basket, the diffuser grille, and into the occupied space. The internal rotatable basket is connected to the diffuser grille so that rotation of the diffuser grille opens and closes the openings and thereby controls the amount of air flowing through the floor terminal. U.S. Pat. No. 6,290,596 issued to Birdsong, discloses a modular floor terminal with a stationary basket and a rotatable basket connected to the diffuser grille.

The air diffuser terminal disclosed in Birdsong '596 is secured the floor opening by gripping engagement of the upper floor surface and the lower floor surface between a trim ring extending around the periphery of the diffuser grille and a retaining ring, respectively. The retaining ring is rotated with respect to the trim ring such that cammed grooves urge the retaining ring against the lower floor surface while drawing the trim ring downwardly against the upper floor surface. A latching mechanism on the retaining ring engages with latching teeth of the trim ring to prevent rotation and thereby disengagement of the retaining ring.

While the Birdsong '596 air diffuser terminal may be installed and secured in the floor opening by a worker position above the floor, the design of the retaining ring and trim ring interface is unnecessarily complicated.

SUMMARY OF THE INVENTION

It is therefore an object of the present invention to provide a modular air diffuser terminal having a simplified low cost mounting flange for securing the HVAC air diffuser terminal in a floor opening.

In accordance with the present invention, an air diffuser terminal is mounted in an opening in a floor or other support structure. The air diffuser terminal includes an air diffuser grille, a basket, and a mounting flange. The mounting flange secures the air diffuser terminal to the floor. The mounting flange comprises a trim ring and a flange clip slideably attached to the trim ring.

The trim ring is dimensioned to fit the floor opening and has a downward gripping surface or lip to engage the top of the floor. The trim ring also has a plurality of vertical slide tracks, each in the form of a vertical slot, extending downwardly from the lip. Each vertical slot has at least one ratchet located on the trim ring adjacent the vertical slot. The ratchet defines a range of adjustment corresponding to the thickness of the floor or other support structure in which the air diffuser terminal will be mounted.

The flange clip includes an attachment portion and an outwardly extending arm with an upward gripping surface. The attachment portion of the flange clip has grooves that engage the edges of the vertical slot. The flange clip also has a pawl that engages the ratchet to lock the flange clip at a vertical position so that the floor is captured between the lip of trim ring and the outwardly extending arm of the flange clip. The flange clip also includes a tab for disengaging the pawl from the ratchet so that the flange clip may be lowered relative the floor and may also be removed from the trim ring.

The mounting flange may also include one or more screws connected between the trim ring and the flange clip to draw the flange clip against the underside of the floor so that the floor is captured between the outwardly extending arm of the flange clip and the lip of the trim ring. The mounting flange of the present invention permits installation of the diffuser by an operator located above the surface of the floor, such that installation may be readily accomplished by simply reaching through the trim ring and into the diffuser basket. The mounting flange of the present invention thereby provides a cost effective method of installing an HVAC terminal in a floor opening.

Further objects, features and advantages of the present invention will become apparent upon consideration of the following detailed description of the invention when viewed in conjunction with the drawings and the appended claims.

BRIEF DESCRIPTION OF THE SEVERAL VIEWS OF THE DRAWINGS

FIG. 1 is a side elevation view of a conventional air diffuser terminal installed in an opening in a floor.

FIG. 2 is a side perspective view of a mounting flange for an air diffuser terminal in accordance with the present invention.

FIG. 3 is a front perspective view of the mounting flange for an air diffuser terminal in accordance with the present invention.

FIG. 6 is a detailed side perspective view of the mounting flange for an air diffuser terminal in accordance with the present invention.

FIG. 7 is a detailed a front perspective view of the mounting flange for an air diffuser terminal in accordance with the present invention.

DETAILED DESCRIPTION OF THE INVENTION

Figure 4:
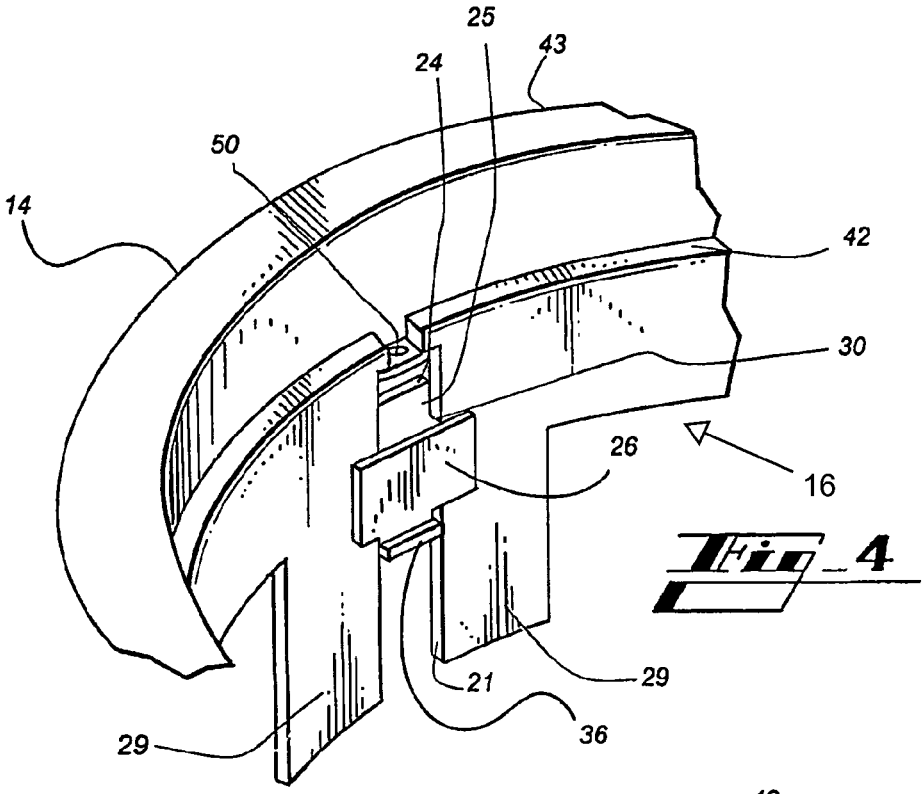
FIG. 4 is an inside perspective view of the diffuser mounting flange for an air diffuser terminal in accordance with the present invention.

Turning to FIG. 1, a conventional basket type, air diffuser terminal 110 comprises a diffuser grille 111, a basket 108, and a mounting flange 116. Such a conventional air diffuser terminal 110 is mounted in an opening (or bore) 106 in a floor or other support structure 112 and is retained by the mounting flange 116. The mounting flange 116 comprises a trim ring 114 and a retaining ring 120 that respectively grip the upper and lower surfaces of the floor 112. The trim ring 114 has a lip 143 that bears against the top surface of the floor 112. The retaining ring 120 is threadingly engaged with the trim ring 114 to secure the air diffuser terminal 110 to the top and bottom surfaces of the floor 112. Particularly, the retaining ring 120 is rotated into engagement with the bottom of the floor 112 and the lip 143 engages the top surface of the floor 112. An air plenum below the floor 112 delivers heating and cooling air produced by the HVAC system to the air diffuser terminal 110. As shown in FIG. 1, the air diffuser terminal 110 further comprises an outer stationary basket 108 that includes a plurality of vertically aligned openings 118. The air in the plenum passes through the openings 118, into the basket 108, and through the diffuser grille 111 to the heated and cooled space (or room) above the floor 112. A rotatable basket (not shown), having corresponding openings 118, is nested within the stationary basket 108 for relative rotation such that rotating basket within stationary basket 108 opens and closes the circumferential openings 118, to regulate the flow of conditioned air through the air diffuser terminal 110. A similar prior art air diffuser terminal is shown in U.S. Pat. No. 6,290,596 issued to Birdsong.

Figure 9:
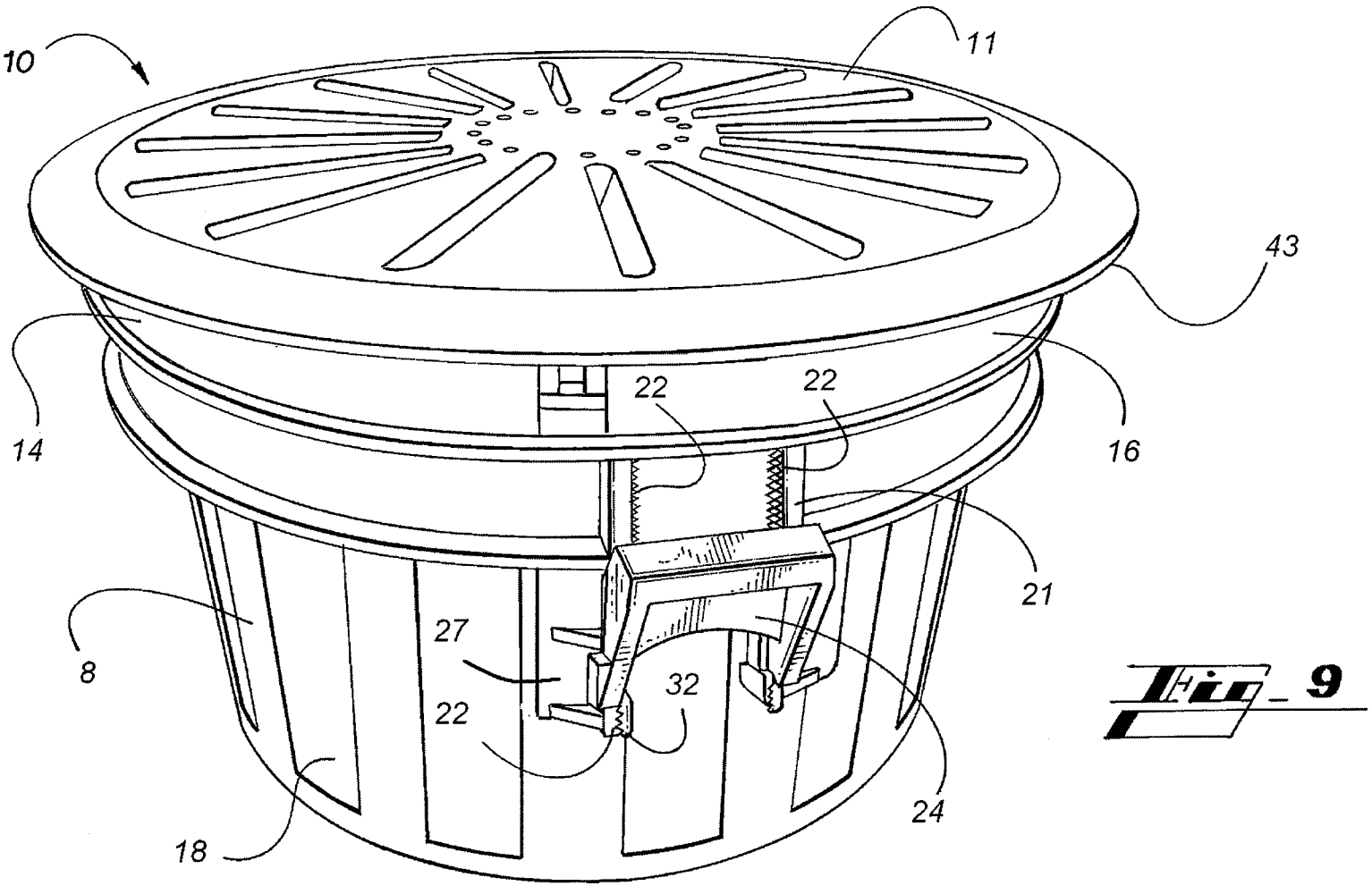
FIG. 9 is a perspective view of an air diffuser terminal having the mounting flange of FIG. 8 in accordance with the present invention.

In accordance with the present invention, an air diffuser terminal 10 is shown in FIG. 9. The air diffuser terminal 10 is mounted in the opening of a floor or other support structure 12. The air diffuser terminal 10 comprises a diffuser grille 11, a basket 8, and a mounting flange 16. The mounting flange 16 secures the air diffuser terminal 10 within the opening in the floor 12. One embodiment of the mounting flange 16 in accordance with the present invention is shown in FIGS. 2-4 and comprises a trim ring 14 and a flange clip 24.

The trim ring 14 is dimensioned fit within the opening in the floor 12. The trim ring 14 has a downward gripping surface or lip 43 extending around its periphery for engaging the top surface of the floor 12. The trim ring 14 has a plurality of vertical tracks on which the flange clip 24 is slidably mounted. As shown in FIGS. 2-4, each vertical track is in the form of a vertical slot 20. Alternatively, the vertical track could be in the form of a rail or other configuration that captures and allows for sliding movement between the ring track 14 and the flange clip 24. The vertical slots 20 extend downwardly from the lip 43 for at least a distance equal to the maximum thickness dimension of the floor 12. The vertical slots 20 have slot edges 21. A series of stepped surfaces, or ratchets 22 are formed along the slot edges 21 of the vertical slots 20 of the trim ring 14. In the embodiment shown in FIGS. 2-4, the ratchets 22 are formed on the outer surface 27 of trim ring 14 adjacent the vertical slots 20, but the ratchets 22 could be formed on the inner surface 29 of trim ring 14 adjacent the vertical slots 20 with similar effectiveness. The length of the ratchets 22 span the range of thickness for the floor 12.

In order to engage the vertical slot 20, the flange clip 24 has an attachment structure 25, which in the illustrated embodiment comprises vertical channels or grooves 30 formed between an inside attachment portion 26 and an outside attachment portion 28. The slot edges 21 of the slot 20 are received in the grooves 30 formed in the flange clip 24 so that flange clip 24 may be raised and lowered within slot 20. Pawls 32 on each side of the flange clip 24 extend inwardly from the outside attachment portion 28 and engage ratchets 22 on both sides of the slot 20 to maintain flange clip 24 in a selected vertical position within slot 20. Preferably, ratchets 22 are formed such that flange clip 24 may slide upwardly with the pawls 32 overriding the ratchets 22, while downward movement is prevented by engagement of the pawls 32 with the ratchets 22.

The slot 20 has a receiving opening 23 positioned at the end of the slot 20 thereby permitting insertion of the flange clip 24 into the slot 20 from the inside of the basket 8 or the inside of the trim ring 14. The slot 20 extends downwardly for a distance from the lip 43 corresponding to the maximum thickness of the floor 12, but not necessarily for the entire height of the basket 8. By leaving the slot 20 open by means of receiving opening 23, the flange clip 24 may be inserted into the slot 20 from within the trim ring 14, facilitating ready installation of the air diffuser terminal 10 by an installer working above the floor 12.

The flange clip 24 comprises an outwardly extending arm 33 having an upward gripping surface 34 that is substantially parallel to the plane of the floor 12 in which the air diffuser terminal 10 is mounted. The upward gripping surface 34 of the outwardly extending arm 33 is urged into engagement with the underside of the floor 12 by sliding the flange clip 24 vertically in the slot 20, while the downward gripping surface and let 43 (FIG. 9) of the trim ring 14 engages an upper surface of the floor 12. The engagement of the pawls 32 with the ratchets 22 maintains each flange clip 24 in engagement with the underside of the floor 12.

Releasing the flange clip 24 from engagement with the trim ring 14 is accomplished by withdrawing the pawls 32 from engagement with ratchets 22. With reference to FIG. 2, an aperture 36 in the outside attachment portion 28 proximal to the pawls 32 improves flexure of the outside attachment portion 28 thereby assisting in the disengagement of the pawls 32 from the ratchets 22. With reference to FIG. 4, which depicts a view of the inner surface 29 of the trim ring 14, a tab 36 extends inwardly from the outside attachment portion 28 and towards the axis of the trim ring 14 or basket 8. A tool, such as a screwdriver, may be pressed against the tab 36, thereby flexing the outside attachment portion 28 of the flange clip 24 and releasing the pawls 32 from the ratchets 22. Flange clip 24 can then be retracted from the floor 12 and moved to an intermediate position or removed entirely.

Figure 5:
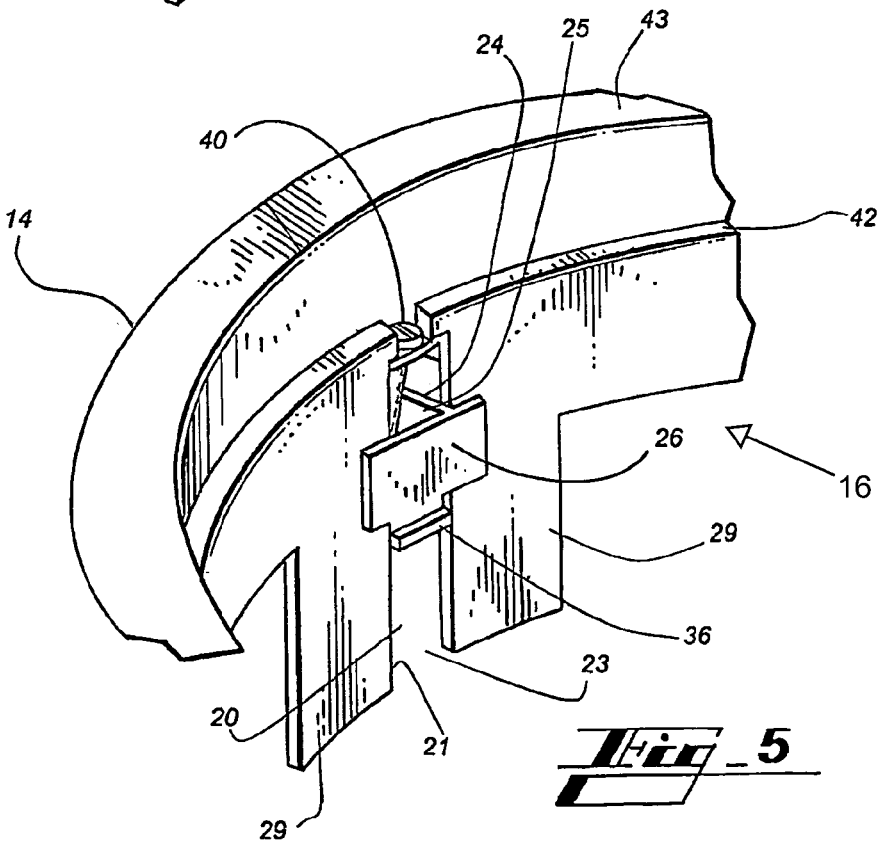
FIG. 5 is an inside perspective view of an alternative embodiment of the mounting flange for an air diffuser terminal in accordance with the present invention.

In another embodiment of the present invention shown in FIGS. 5-7, wherein like parts are numbered the same as the previously described embodiment, the flange clip 24 may further comprise an adjustment screw 40 to draw the flange clip 24 into engagement with the floor 12. The adjustment screw 40 extends from a ledge 42 in the trim ring 14 and engages the flange clip 24 at an angle to the vertical. The screw 40 engages the flange clip 24 by means of a threaded cylinder 44, a trunion 45, and flange clip arms 46 and 48. Rotation of the adjustment screw 40 in a first direction draws the flange clip 24 upwardly in the slot 20 toward the ledge 42 so that a flange clip 24 with its upward gripping surface 34 engages the underside of the floor 12.

With reference to FIG. 5, a bore 50 extends through the ledge 42 of the trim ring flange 14 above the vertical slot 20. The threaded portion of the screw 40 passes through the bore 50 and is threaded into the threaded cylinder 44. Preferably, the bore 50 is counter sunk to receive the head of the screw 40 so that the surface of the ledge 42 remains substantially flat to support and to permit rotation of the diffuser grille 11. The trunion mounting of the threaded cylinder 44 on the flange clip 24 by means of the trunion 45 and the flange clip arms 46 and 48 enables continuous alignment of the screw 40 with the threaded cylinder 44 as the flange clip 24 is drawn upwardly in the slot 20. Alternatively, the screw 40 may be threadingly received through a bore in the flange clip 24 and aligned substantially parallel to a plane defined by the vertical slot 20.

Figure 8:
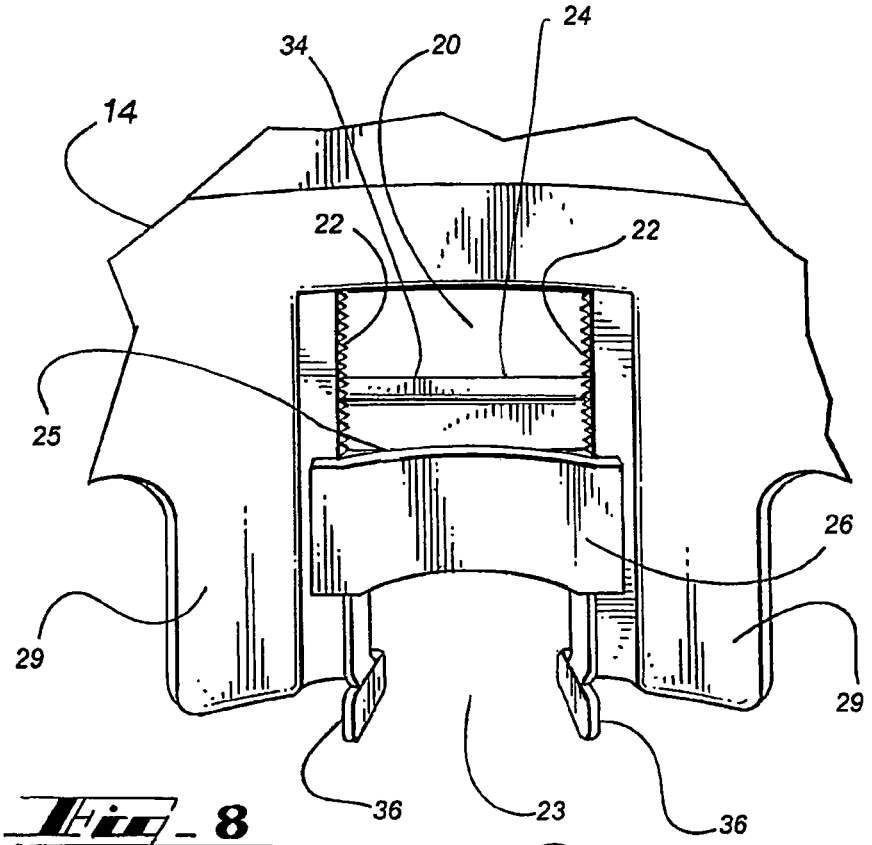
FIG. 8 is a side elevational view of an alternative embodiment of a mounting flange for an air diffuser terminal in accordance with the present invention.
Figure 10:
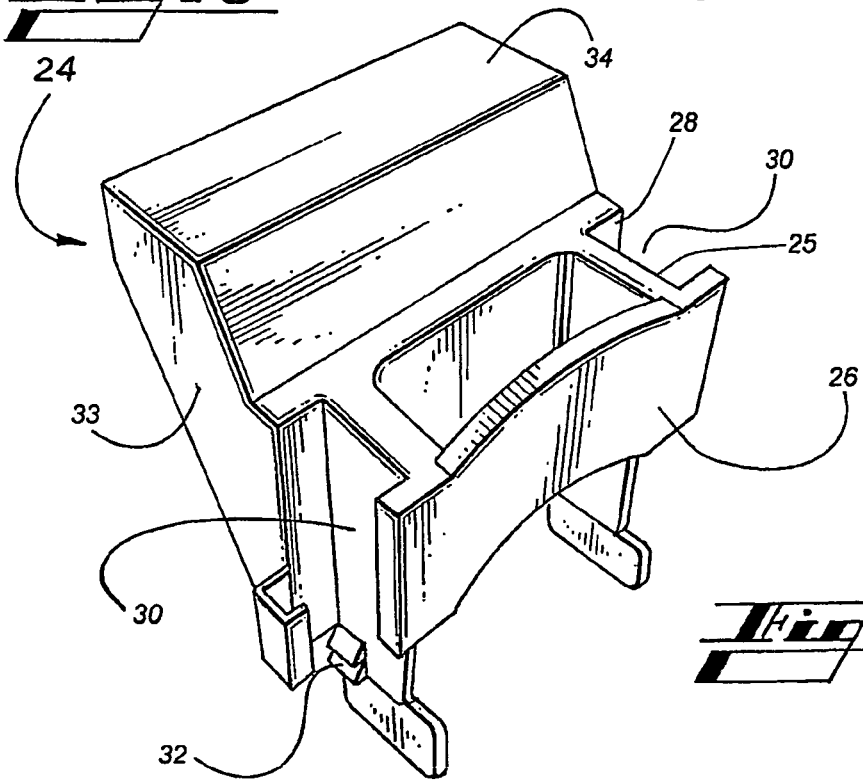
FIG. 10 is perspective view of the flange clip of FIG. 8 in accordance with the present invention.

In another embodiment of the invention shown in FIGS. 8-10, the ratchets 22 are formed in the slot edges 21 of the vertical slots 20. The ratchets 22 face inwardly within the vertical slots 20. As with the other embodiments, the flange clip 24 is received in the vertical slot 20 via the receiving opening 23.

As best seen in reference to FIG. 10, the flange clip 24 has vertical grooves 30 formed between the inside attachment portion 26 and the outside attachment portion 28. The slot edges 21 of the slot 20 are received in the grooves 30 so that flange clip 24 may be raised and lowered within slot 20. In this embodiment the pawls 32 extend from the inner surface of the grooves 30 and engage the ratchets 22 on the inwardly facing edges 21 of the slot 20. The pawls 32 and the ratchets 22 maintain the flange clip 24 in its selected position within the slot 20.

The flange clip 24 comprises an outwardly extending arm 33 having an upward gripping surface 34 that is substantially parallel to the plane of the floor 12 in which the air diffuser terminal 10 is mounted. The upward gripping surface 34 is urged into supporting engagement with the floor 12 by sliding the flange clip 24 vertically in the slot 20, while a downward gripping surface or lip 43 of the trim ring flange 14 engages an upper surface of the floor 12. The engagement of the pawls 32 with the ratchets 22 maintains the flange clip 24 in engagement with the underside of the floor 12.

In the embodiment shown in FIGS. 8-10, tabs 36 are coupled with pawls 32 on each side of the flange clip 24. The tabs 36 extend inwardly toward the axis of the trim ring 14. The pawls 32 may be released from their engagement with the ratchets 22 by simply squeezing the tabs 36 toward one another, either by hand or with a tool, such as pliers.

The diffuser mounting flange 16 contemplated by the present invention, permits installation and securement of the diffuser without requiring access to the underside of the floor 12. The flange clip 24 may be installed and secured entirely from above the floor 12 by simply reaching through the interior of the trim ring 14 and into the diffuser basket 8.

While this invention has been described with reference to preferred embodiments thereof, it is to be understood that variations and modifications can be affected within the spirit and scope of the invention as described herein and as described in the appended claims.

I claim:

1. In an air diffuser terminal with a diffuser grille and a basket, a mounting flange for mounting the air diffuser terminal in an opening in a support structure, the mounting flange comprising:

a. a trim ring dimensioned to fit the opening in the support structure comprising:

i. a periphery extending between a top ring opening and a bottom ring opening and having an inside surface and an outside surface, the periphery including:

1. a lip extending outwardly from the periphery of the trim ring adjacent the top ring opening for engaging one surface of the mounting structure;

2. a vertical track comprising an open ended, vertically extending slot formed in the periphery and, extending from below the lip of the trim ring, to the bottom ring opening and intersecting with the bottom ring opening; and 3. a ratchet formed on a portion of the periphery of the trim ring adjacent the slot; and b. a flange clip comprising:

i. an extending arm carried by the flange clip for engaging an opposite surface of the mounting structure;

ii. an attachment structure comprising a groove for engaging and sliding along the open ended, vertically extending slot of the vertical track; and iii. a flexible pawl for engaging the ratchet on the open ended vertical slot, the pawl being accessible from inside the trim ring through the open ended, vertically extending slot, wherein the flange clip moves along the vertical track into engagement with the opposite surface of the support structure and is locked in place by the ratchet and pawl to capture the support structure between the lip of the trim ring and the extending arm of the flange clip and wherein the flexible pawl flexes away from the ratchet to withdraw the flexible pawl from engagement with the ratchet.

2. The mounting flange of claim 1, wherein the ratchet is on the outer surface of the trim ring adjacent the vertical slot.

3. The mounting flange of claim 1, wherein the ratchet is on the inner surface of the trim ring adjacent the vertical slot.

4. The mounting flange of claim 1, wherein ratchet is on the inwardly facing surface on the trim ring of the vertical slot.

5. The mounting flange of claim 1, wherein the flange clip comprises a left pawl and a right pawl, and each pawl engages a ratchet on a corresponding left side and right side of the vertical slot.

6. The mounting flange of claim 1, wherein the flange clip further comprises at least one tab connected to the flexible pawl and operable to disengage the flexible pawl from the ratchet.

7. The mounting flange of claim 1, wherein the ratchet has a predetermined range of length corresponding to a thickness of the support structure in which the diffuser is mounted.

8. The mounting flange of claim 1, wherein the mounting flange further comprises a screw extending through the lip and rotatably coupled with the flange clip, wherein rotation of the screw in a first direction draws the flange clip upwardly along the slot.

9. The mounting flange of claim 8, wherein the screw is at an angle to the vertical and is connected to the flange clip by a threaded cylinder and a trunion mounted between a pair of flange clip arms.

10. An air diffuser terminal for mounting in an opening in a support structure comprising:

a. a diffuser grille;

b. a basket; and c. a mount flange, of the mounting flange comprising:
  i. a trim ring dimensioned to fit the opening in the support structure comprising:
    1. a periphery extending between a top ring opening and a bottom ring opening and having an inside surface and an outside surface, the periphery including:
      a. a lip extending outwardly from the periphery of the trim ring adjacent the top ring opening for engaging one surface of the mounting structure;
      b. a vertical track comprising an open ended, vertically extending slot formed in the periphery and extending from below the lip of the trim ring to the bottom ring opening and intersecting with the bottom ring opening; and
      c. a ratchet formed on a portion of the periphery of the trim ring adjacent the slot; and
  ii. a flange clip comprising:
    1. an extending arm carried by the flange clip for engaging an opposite surface of the mounting structure;
    2. an attachment structure comprising a groove for engaging and sliding along the open ended, vertically extending slot of the vertical track; and
    3. a flexible pawl for engaging the ratchet on the open ended, vertically extending slot, the pawl being accessible from inside the trim through the vertical slot, wherein the flange clip moves along the vertical track into engagement with the opposite surface of the support structure and is locked in place by the ratchet and pawl to capture the support structure between the lip of the trim ring and the extending arm of the flange clip and wherein the flexible pawl flexes away from the ratchet to withdraw the flexible pawl from engagement with the ratchet.

11. The air diffuser terminal of claim 10, wherein the ratchet is on the outer surface of the trim ring adjacent the vertical slot.

12. The air diffuser terminal of claim 10, wherein the ratchet is on the inner surface of the trim ring adjacent the vertical slot.

13. The air diffuser terminal of claim 10, wherein the ratchet is on the inwardly facing surface on the trim ring of the vertical slot.

14. The air diffuser terminal of claim 10, wherein the flange clip comprises a left pawl and a right pawl, and each pawl engages a ratchet on a corresponding left side and right side of the vertical slot.

15. The air diffuser terminal of claim 10, wherein the flange clip further comprises at least one tab connected to the flexible pawl and operable to disengage the flexible pawl from the ratchet.

16. The air diffuser terminal of claim 10, wherein the ratchet has a predetermined range of length corresponding to a thickness of the support structure in which the diffuser is mounted.

17. The air diffuser terminal of claim 10, wherein the mounting flange further comprises a screw extending through the lip and rotatably coupled with the flange clip, wherein rotation of the screw in a first direction draws the flange clip upwardly along the slot.

18. The air diffuser terminal of claim 17, wherein the screw is at an angle to the vertical and is connected to the flange clip by a threaded cylinder and a trunion mounted between a pair of flange clip arms.

19. In an air diffuser terminal with a diffuser grille and a basket, a mounting flange for mounting the air diffuser terminal in an opening in a support structure, the mounting flange comprising:
  a. a trim ring dimensioned to fit the opening comprising:
    i. a lip extending outwardly from the trim ring for engaging one surface of the mounting structure;
    ii. a vertical track comprising a vertical slot, an outer surface, an inner surface, and an inwardly facing surface extending below the lip of the trim ring; and
    iii. a ratchet formed on a portion of the trim ring adjacent the slot; and
  b. a flange clip comprising:
    i. an extending arm carried by the flange clip for engaging an opposite surface of the mounting structure;
    ii. an attachment structure comprising a groove for engaging and sliding along the vertical slot of the vertical track; and
    iii. a flexible pawl for engaging the ratchet on the vertical slot, wherein the flange clip moves along the vertical track into engagement with the opposite surface of the support structure and is locked in place by the ratchet and pawl to capture the support structure between the lip of the trim ring and the extending arm of the flange clip, wherein the flexible pawl flexes away from the ratchet to withdraw the flexible pawl from engagement with the ratchet, wherein the mounting flange further comprises a screw extending through the lip and rotatably coupled with the flange clip, wherein rotation of the screw in a first direction draws the flange clip upwardly along the slot, and wherein the screw is at an angle to the vertical and is connected to the flange clip by a threaded cylinder and a trunion mounted between a pair of flange clip arms.

20. The mounting flange of claim 19, wherein the ratchet is on the outer surface of the trim ring adjacent the vertical slot.

21. The mounting flange of claim 19, wherein the ratchet is on the inner surface of the trim ring adjacent the vertical slot.

22. The mounting flange of claim 19, wherein ratchet is on the inwardly facing surface on the trim ring of the vertical slot.

23. The mounting flange of claim 19, wherein the flange clip comprises a left pawl and a right pawl, and each pawl engages a ratchet on a corresponding left side and right side of the vertical slot.

24. The mounting flange of claim 19, wherein the flange clip further comprises at least one tab connected to the flexible pawl and operable to disengage the flexible pawl from the ratchet.

25. The mounting flange of claim 19, wherein the ratchet has a predetermined range of length corresponding to a thickness of the support structure.

26. An air diffuser terminal for mounting in an opening in a support structure comprising:
  a. a diffuser grille;
  b. a basket; and
  c. a mount flange, of the mounting flange comprising:
    i. a trim ring dimensioned to fit the opening comprising:
      1. a lip extending outwardly from the trim ring for engaging one surface of the mounting structure;
      2. a vertical track comprising a vertical slot, an outer surface, an inner surface, and an inwardly facing surface extending below the lip of the trim ring; and
      3. a ratchet formed on a portion of the trim ring adjacent the slot; and ii. a flange clip comprising:

1. an extending arm carried by the flange clip for engaging an opposite surface of the mounting structure;
2. an attachment structure comprising a groove for engaging and sliding along the vertical slot of the vertical track; and
3. a flexible pawl for engaging the ratchet on the vertical slot, wherein the flange clip moves along the vertical track into engagement with the opposite surface of the support structure and is locked in place by the ratchet and pawl to capture the support structure between the lip of the trim ring and the extending arm of the flange clip, wherein the flexible pawl flexes away from the ratchet to withdraw the flexible pawl from engagement with the ratchet, wherein the mounting flange further comprises a screw extending through the lip and rotatably coupled with the flange clip, wherein rotation of the screw in a first direction draws the flange clip upwardly along the slot, and wherein the screw is at an angle to the vertical and is connected to the flange clip by a threaded cylinder and a trunion mounted between a pair of flange clip arms.

27. The air diffuser terminal of claim 26, wherein the ratchet is on the outer surface of the trim ring adjacent the vertical slot.

28. The air diffuser terminal of claim 26, wherein the ratchet is on the inner surface of the trim ring adjacent the vertical slot.

29. The air diffuser terminal of claim 26, wherein the ratchet is on the inwardly facing surface on the trim ring of the vertical slot.

30. The air diffuser terminal of claim 26, wherein the flange clip comprises a left pawl and a right pawl, and each pawl engages a ratchet on a corresponding left side and right side of the vertical slot.

31. The air diffuser terminal of claim 26, wherein the flange clip further comprises at least one tab connected to the flexible pawl and operable to disengage the flexible pawl from the ratchet.

32. The air diffuser terminal of claim 26, wherein the ratchet has a predetermined range of length corresponding to a thickness of the support structure in which the diffuser is mounted.

* * * * *